US006010017A

United States Patent [19]

Michaelis et al.

[11] Patent Number: 6,010,017

[45] Date of Patent: Jan. 4, 2000

[54] MODULAR DISPENSER AND DISPLAY SYSTEM

[75] Inventors: Jack Michaelis, Barrington; Dennis Nielsen, Long Grove; Russ Barnes, Bloomingdale; Donald Wendel, Mount Prospect, all of Ill.

[73] Assignee: Visual Marketing Incorporated, Chicago, Ill.

[21] Appl. No.: 08/887,098

[22] Filed: Jul. 2, 1997

[51] Int. Cl.[7] ..... A47F 5/00

[52] U.S. Cl. ..... 211/133.4; 211/107; 211/205; 211/182; 248/297.21; 248/230.2

[58] Field of Search ..... 211/133.4, 107, 211/131.1, 205, 182; 248/297.21, 230.2, 413, 218.4

[56] References Cited

U.S. PATENT DOCUMENTS

| | | | |
|---|---|---|---|
| 446,472 | 2/1891 | Roberts . | |
| 1,339,525 | 5/1920 | Rod . | |
| 1,358,792 | 11/1920 | Shognan . | |
| 1,735,051 | 11/1929 | Moe . | |
| 1,748,228 | 2/1930 | Jacobs | 211/107 |
| 1,813,059 | 7/1931 | Lee . | |
| 1,864,491 | 6/1932 | Hopp . | |
| 1,915,727 | 6/1933 | Friedemann . | |
| 2,155,097 | 4/1939 | Mendle . | |
| 2,290,410 | 7/1942 | Dawson . | |
| 2,689,050 | 9/1954 | Albin . | |
| 2,765,136 | 10/1956 | Knapp . | |
| 2,946,456 | 7/1960 | Liguori . | |
| 3,119,588 | 1/1964 | Keats . | |
| 3,194,403 | 7/1965 | Van Horn, Jr. . | |
| 3,245,365 | 4/1966 | Doherty . | |
| 3,332,654 | 7/1967 | Jacobson | 211/107 |
| 3,692,188 | 9/1972 | Bayne . | |
| 3,963,126 | 6/1976 | Taub . | |
| 4,010,698 | 3/1977 | Taub . | |
| 4,094,417 | 6/1978 | Cairnes et al. | 211/182 X |
| 4,117,629 | 10/1978 | Ekdahl | 211/107 X |
| 4,193,351 | 3/1980 | Belokin, Jr. . | |
| 4,262,439 | 4/1981 | Dinan et al. . | |
| 4,343,842 | 8/1982 | Chase . | |
| 4,453,640 | 6/1984 | Cillario | 211/133.4 |
| 5,715,955 | 2/1998 | Hannacke | 211/205 X |
| 5,735,413 | 4/1998 | Allen | 211/133.4 X |
| 5,746,334 | 5/1998 | Brandenberg | 211/205 |

*Primary Examiner*—Robert W. Gibson, Jr.
*Attorney, Agent, or Firm*—Brinks Hofer Gilson & Lione

[57] ABSTRACT

The present invention provides a modular dispenser and display system having a foundational unit. A supporting collar can be mounted to the foundational unit at any position and at any height. The supporting collar also has a plurality of attachment means aligned vertically and peripherally on the supporting collar and one or more trays can be mounted to the supporting collar.

18 Claims, 11 Drawing Sheets

40
44
43
45
42

MODULAR DISPENSER AND DISPLAY SYSTEM

BACKGROUND OF THE INVENTION

This invention relates to a system of displaying, dispensing, and advertising small packaged goods, such as cigarettes. More specifically, the invention relates to modular system having different combinations of advertising displays and dispenser trays.

Numerous types of shelving units have been developed over the years for displaying and dispensing small packaged goods, such as cigarettes. Some of these shelving units were suspended from the ceiling. These ceiling mounted units held a number of the packaged goods in vertical stacks. Thus, either a customer or a store employee could select the bottom product and the remaining products would fall into the vacant dispensing opening. Some of these units provided a large space for advertising on panels that covered the vertical stacks of packages.

Countertop dispenser and display units also have been used. One known countertop model consisted of a plurality of vertical supports. Each vertical support has a plurality of equally spaced holes. These units also have wire trays with pegs that fit into the holes in the vertical supports. By inserting the pegs of the trays into certain holes in the vertical supports, the height of the tray can be varied. These units typically also have a top panel that allows for the placement of an advertisement.

The disadvantage of both the countertop and the ceiling mounted types of dispenser and display device is their inflexibility. In the countertop model, for example, the trays can only be altered vertically, between the predetermined heights as set by the holes in the vertical supports. In addition, trays and advertising signs used in both types of prior art dispensers and displays cannot be horizontally adjusted, either front to back or side to side. Furthermore, the size of the trays cannot be altered to hold packages of different sizes, the advertising displays must conform to the size of pre-manufactured spaces, and some advertisements are not illuminated.

Accordingly, it is an object of the present invention to provide a dispenser and display system that is flexible because it is modular in nature and utilizes different types of interchangeable parts.

It is also an object of the present invention to provide a dispenser and display system that is fully adjustable, with trays and advertising display units that can be adjusted to any desired height or any desired horizontal orientation, and trays that are expandable to support a variety of sizes and quantities of packages.

Yet another object of the present invention is to provide an adjustable advertising display unit that can be angled toward point of purchase customers and illuminated, and therefore be more attractive to customers.

SUMMARY OF THE INVENTION

The present invention provides a modular dispenser and display system having a foundational unit such as a column connected to a base. A supporting collar can be mounted on the foundational unit at any position, and therefore, at any height. The supporting collar has at least one attachment means aligned vertically and peripherally on the supporting collar. One or more trays that can be mounted to the supporting collar.

The present invention provides a modular dispenser and display system that offers a variety of configurations to the user through the use of a small number of individual components and simple interlocking parts. It is to be understood that both the foregoing general description and the following detailed description are exemplary and explanatory. The invention, together with further objects and attendant advantages, will best be understood by reference to the following detailed description, taken in conjunction with the accompanying drawings.

DETAILED DESCRIPTION OF THE PREFERRED EMBODIMENT

Figure 1:
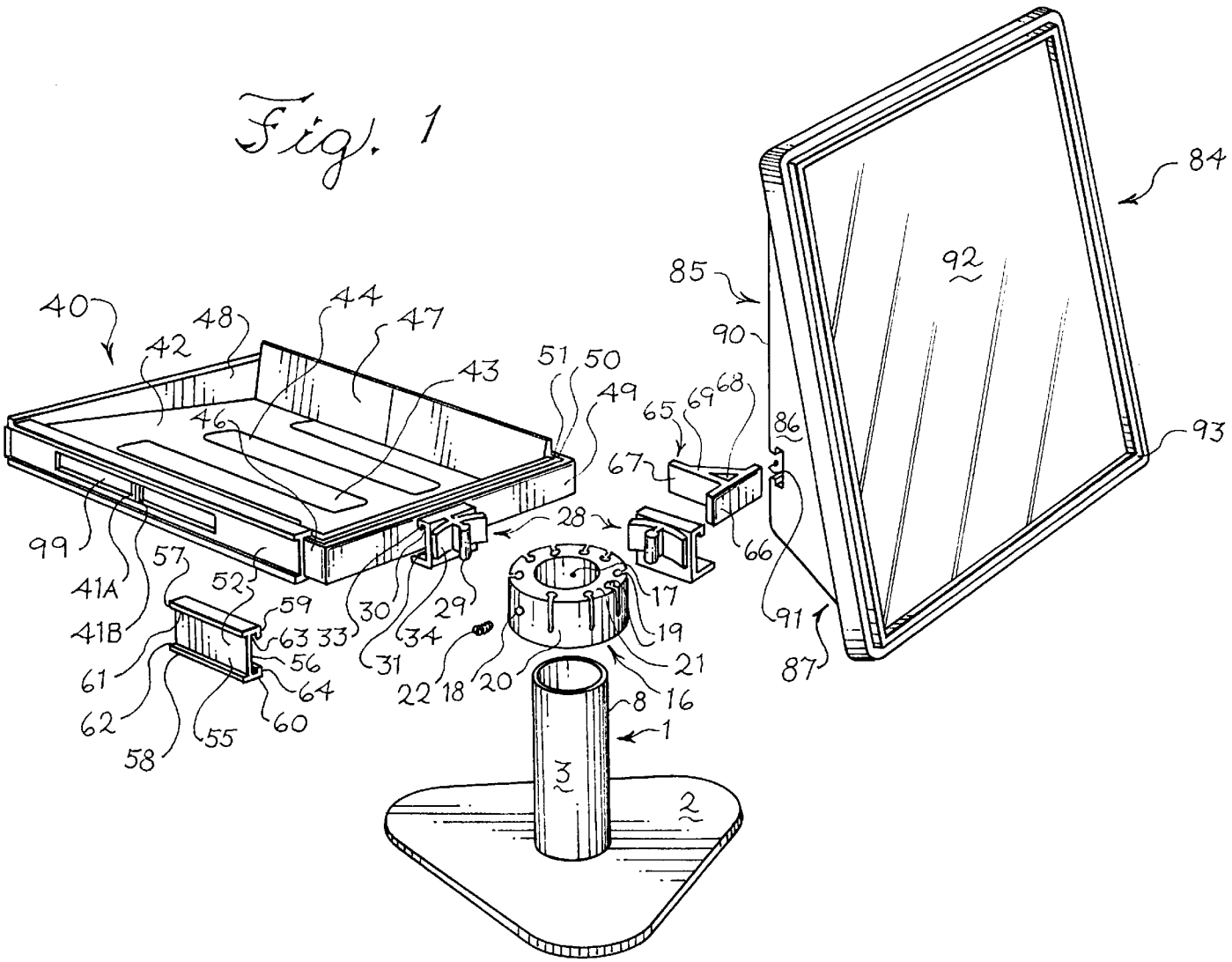
FIG. 1 is a perspective view of the first embodiment of a modular dispenser and display system of the present invention.

Turning now to the drawings, FIG. 1 is a perspective view of the preferred embodiment of a countertop mounted modular dispenser and display system, in particular showing the various individual components of the system, including a foundational unit 1, a supporting collar 16, a clip 28, an expandable tray 40, a support arm 65, and a display unit 84.

Figure 2:
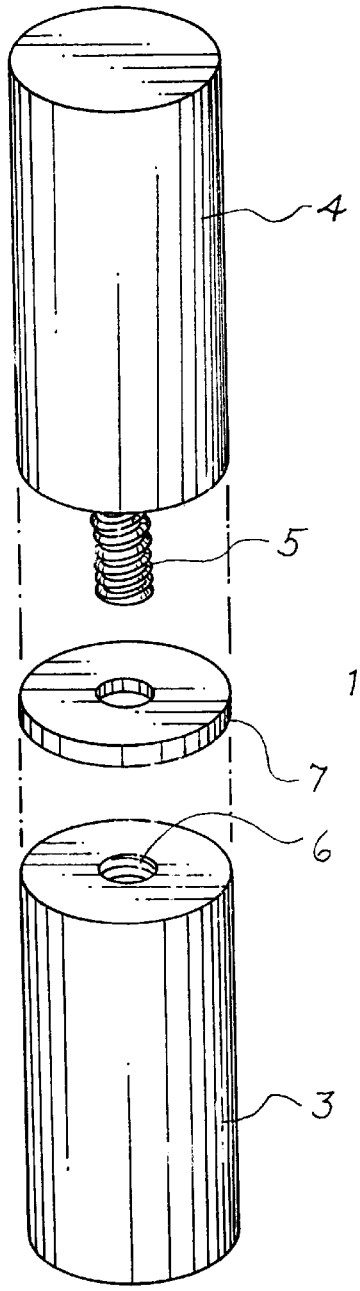
FIG. 2 is a perspective view of a column and an extension portion.

In FIG. 1, one embodiment of the foundational unit 1 is shown comprised of a base 2 and a column 3. The column 3 preferably has a cylindrical cross section and is anchored to the base 2. A column 3 may also be adjustable in height. The height of a column 3 can be adjusted by using an extension portion 4 as shown in FIG. 2. In the preferred embodiment of a countertop modular dispenser and display system, a column 3 has a threaded hole 6 through its center.

The threaded hole 6 allows an extension portion 4, with a threaded post 5, to be rotatably attached to a column 3. For added stability, an alignment ring 7 is preferably secured between the column 3 and the extension portion 4.

Figure 3:
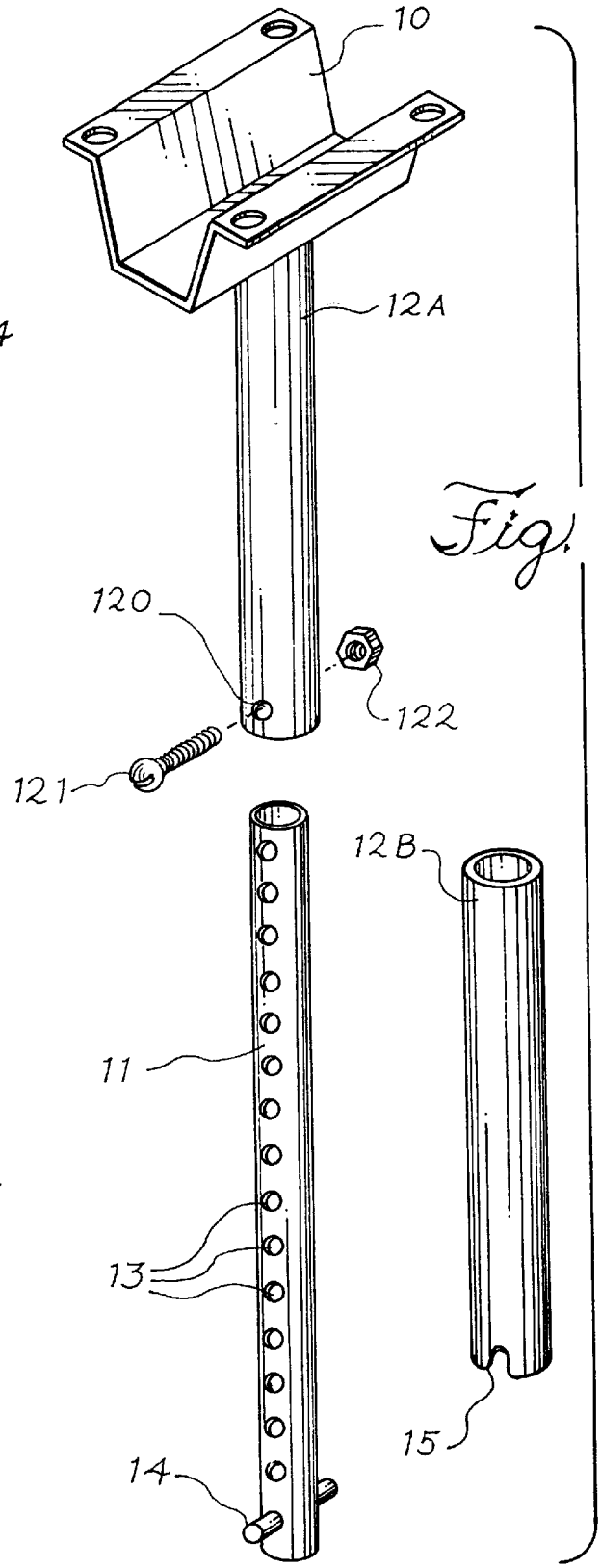
FIG. 3 is a perspective view of an alternate embodiment of a column.

In an alternate embodiment of a column, preferably used with a ceiling mounted modular dispenser and display system, the height of a column 3 can be adjusted as shown in FIG. 3. In FIG. 3, a base 10 is attached to a ceiling, and a first hollow outer column 12A is attached to the base 10. The first outer column 12A has two aligned holes (one shown) 120. An inner column 11 fits loosely inside the first outer column 12A and has a plurality of holes 13 through the column and aligned along the length of the column. A second hollow outer column 122B fits loosely around the inner column 11 and has notches 15 at its bottom edge. The second outer column 12B is held in place around the inner column 11 by a fixed cross pin 14 that is secured near the bottom of the inner column 11. The pin 14 extends beyond the outer edge of the inner column 11, and the notches 15 in the second outer column 122B rest on the ends of the pin 14 that extend beyond the outer edge of the inner column 11. The height of the entire column 3 can be adjusted by aligning different holes 13 in the inner column 11 with the holes 120 in the first outer column 12A, passing a cross screw 121 through the aligned holes, and securing the cross screw 121 with a nut 122.

In addition to the countertop and ceiling-mounted embodiments of the modular dispenser and display system partially described above, which preferably have foundational units comprised of a base and a column, alternative embodiments of the invention may also have a wall mounted foundational unit. In a wall mounted embodiment of the modular dispenser and display system, the foundational unit could be comprised of a peg board, slat wall, or other wall anchoring device.

Returning to FIG. 1, the preferred embodiment has a supporting collar 16. For countertop and ceiling mounted systems, the supporting collar 16 is preferably slipped over and mounted around the column 3. The supporting collar 16 has an interior circumference 17 that is substantially equal to the exterior circumference 8 of the column 3. In the preferred embodiment, the supporting collar 16 also has a threaded hole 18 aligned horizontally through its outside surface 20. The supporting collar 16, is then preferably mounted to a column 3 by means of a screw 22.

The supporting collar 16 also has a plurality of attachment means that are used to receive and support a clip 28. As shown in FIG. 1, the attachment means of the preferred embodiment are comprised of slots 19 that open on the top surface 21 of the supporting collar 16 and extend vertically down the outside surface 20 of the supporting collar 16. The slots 19 are equally and peripherally spaced on the outside surface 20 of the supporting collar 16, preferably at 30 degree angles from the center of the supporting collar 16. In alternative embodiments, the attachment means may take on other forms, such as holes, pegs, or hooks, and the shape of the clip, described below, would conform to such an attachment means.

Figure 4A:
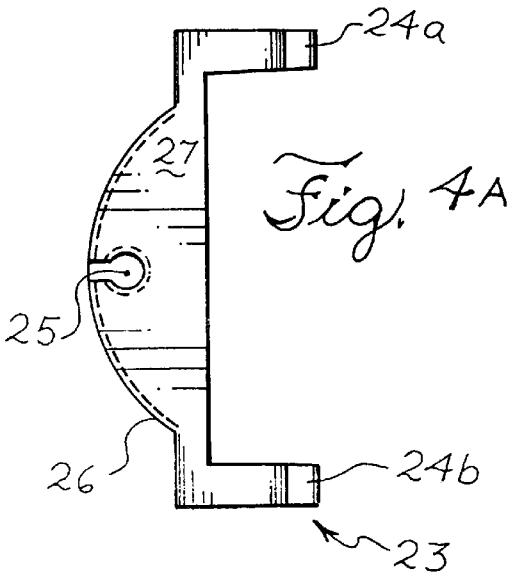
FIG. 4A is a plan view of an alternative embodiment of a supporting collar.
Figure 4B:
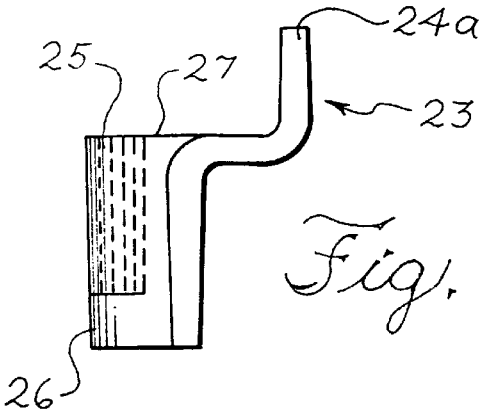
FIG. 4B is a side view of an alternative embodiment of a supporting collar.

In wall-mounted systems, an alternative embodiment of the supporting collar 16 in FIG. 1 can be used. In FIGS. 4A and 4B, an alternative embodiment of a supporting collar 23 that can be mounted on a peg board wall mounting system is shown. As shown in both FIGS. 4A and 4B, the supporting collar 23 preferably has two hooks 24A,24B that fit in the holes of a peg board, moveably mounting the supporting collar 23 to the peg board. As shown in FIG. 4A, the supporting collar 23 also preferably has at least one slot 25. As in the other embodiments described above, the slots 25 are open on the top surface 27 and along the outside surface 26 of the supporting collar 23. The preferred embodiment of a wall-mounted modular dispenser and display system has a plurality of supporting collars 23 with one slot 25 on each supporting collar 23. Alternate embodiments, however, may have supporting collars 23 with a plurality of slots 25.

Returning to FIG. 1, a clip 28 is used to connect one or more trays 40 or support arms 65 to the supporting collar 16. One side of a clip 28 attaches to the supporting collar 16 and is comprised of a peg 29 and a brace 34. The peg 29 is designed to be inserted into the slots 19 and held snugly in the supporting collar 16 in such a way that the brace 34 conforms in shape to the outside surface 20 of the supporting collar 16. This provides a secure and tight connection between the clip 28 and the supporting collar 16. In the preferred embodiment, the stability of the connection between the clip 28 and the supporting collar 16 is enhanced by tapering the slot 19 and the peg 29 from top to bottom.

Figure 5:
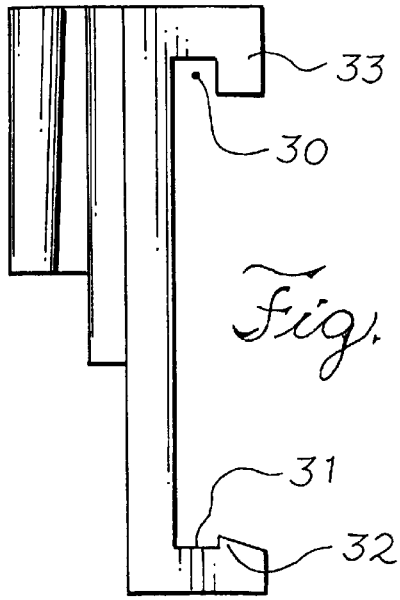
FIG. 5 is a side view of a clip of the modular dispenser and display system of FIG. 1.

In one embodiment, the opposite side of a clip 28 holds objects with planar surfaces, preferably expandable trays 40 and support arms 65, between opposed grooves 30, 31. In the preferred embodiment, the opposed grooves 30, 31 consist of a downward facing groove 30 and an upward facing groove 31. As shown in FIG. 5, the upward facing groove 31 and the downward facing groove 30 are preferably oriented in such a way that a planar member could be supported between them. FIG. 5 also shows how a downward facing groove 30 is preferably formed by a lip 33 and the upward facing groove 31 is preferably formed by a barb 32. The use of a barb 32 to form a upward facing groove 31 allows a clip 28 to snap onto a planar object.

Figure 6:
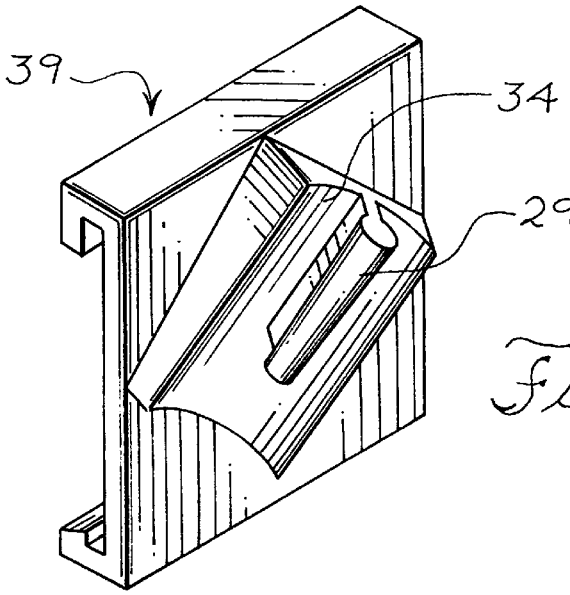
FIG. 6 is a perspective view of an alternative embodiment of a clip.

The clip 28 can support various types of planar objects in the modular dispenser and display system. In FIG. 1, a clip 28 is used to connect trays 40 and support arms 65 to a supporting collar 16 and to hold the trays 40 and support arms 65 in horizontal positions. In FIG. 6, an alternate embodiment of a clip 39 is shown that can be used in the modular dispenser and display system to hold objects at an angle. The angled clip 39 is comprised of the same elements as the straight clip 28 in FIG. 1, except that the peg 29 and brace 34 side of the clip is connected to the opposed grooves side of the clip at an angle, preferably 45 degrees.

Referring back to FIG. 1, an expandable tray 40 is one type of item that can be held by and connected to the supporting collar 16 by a clip 28. An expandable tray 40 is preferably used in a modular dispenser and display system to hold small packaged goods and is comprised of a bottom 42, a front wall 46, a back wall 47, a plurality of side walls 48,49, a front bracket 52, and a back bracket (not shown). Each wall 46,47,48,49 has an upper surface 50 with a groove 51. A groove 51 is designed to accept either the lip 33 of the clip 28 or a bracket. The lip 33 is slideably mounted within the groove 51 of the expandable tray 40, allowing the tray 40 to be slid along the clip 28 in either a forward or backward direction. The tray 40 can also be adjusted from side to side by slideably mounting the clip 28 to the back bracket.

As shown in FIG. 1, the bottom 42 of an expandable tray 40 is preferably comprised of interlocking fingers 43,44, and both the front wall 46 and the back wall 47 preferably each have a pair of slide stops (front shown) 41A, 41B The expandable tray 40 also preferably has a front bracket 52 with a hole 99 in its center for the slide stops 41A,41B. The front bracket 52 is preferably a vertically oriented planar member that has two sides, a front side 55 and back side 56. Both the front side 55 and back side 56 have a pair of opposed grooves 61,62, and 63,64, respectively. Each pair of opposed grooves 61,62 and 63,64 are oriented in such a way as to accept and hold a vertically oriented planar member, and each individual groove 61,62,63,64 is formed by a lip 57,58,59,60. On the back side 56, the upper lip 59 fits and is held within the groove 51 on an expandable tray 40. The front bracket 52 is also preferably used as a display to hold a planar product advertisement between the opposed grooves 61,62 on the front side 55 of the front bracket 52.

In FIG. 1, an expandable tray 40 is shown in the closed position. The slide stops 41 are in the center of the hole 99 in the front bracket 52, and the interlocking fingers 43,44 of the tray bottom 42 are together. When the tray 40 is expanded, the slide stops 41 move toward the side walls until they are stopped by the edge of the hole in the front bracket 52, and the interlocking fingers 43,44 are pulled apart, allowing the user to adjust the overall width of an expandable tray 40, thereby increasing the area of the bottom 42.

Figure 7:
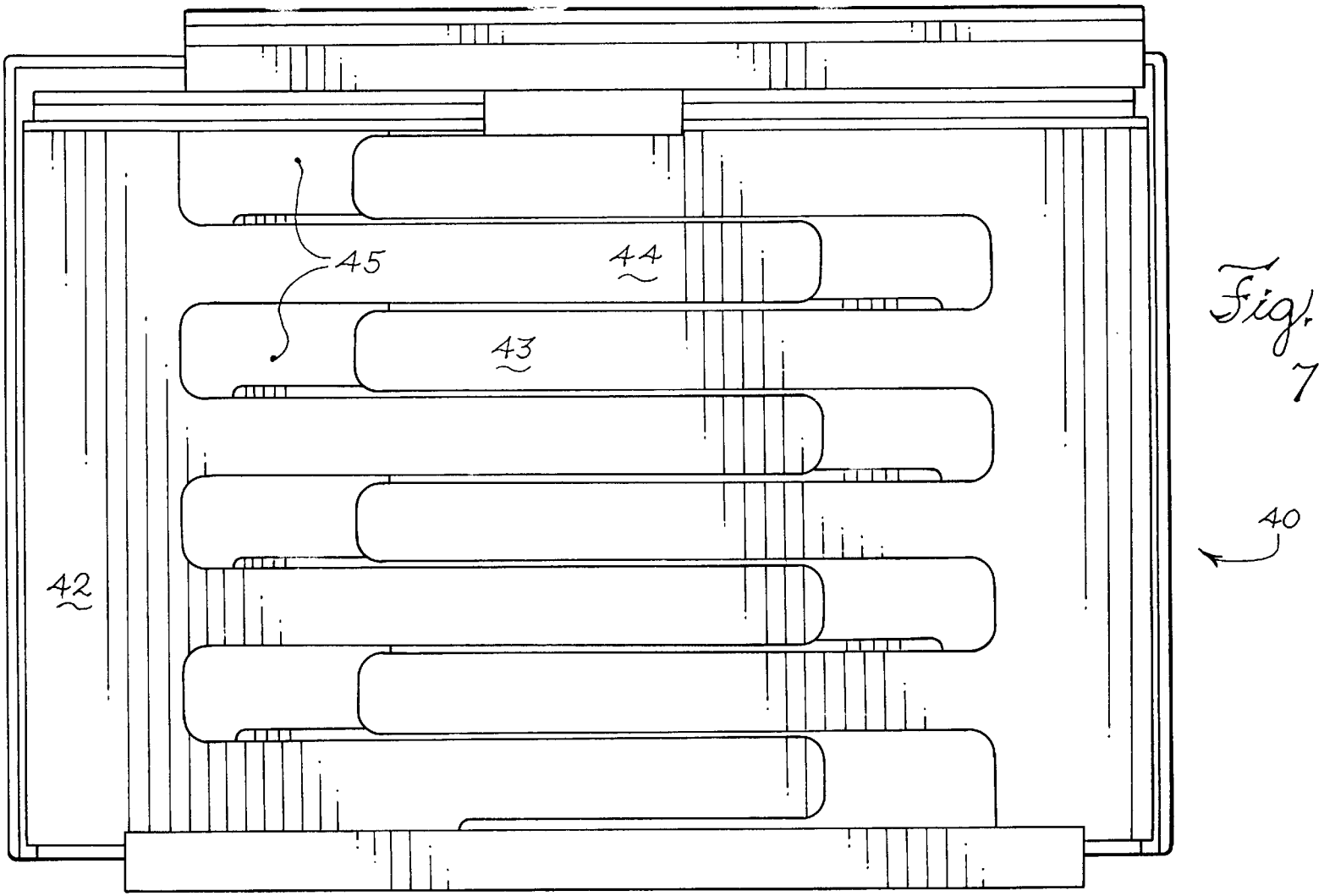
FIG. 7 is a plan view of a tray, shown in an expanded position.

In FIG. 7, the expandable tray 40 is shown in an expanded position. When the expandable tray 40 and the interlocking fingers 43,44 are pulled apart, holes 45 are formed in the bottom portion 42 of an expandable tray 40. By utilizing interlocking fingers 43,44 for the preferred embodiment tray bottom 42, packaged goods that are placed in an expandable tray 40 will be supported by the interlocking fingers 43,44 and not fall through the holes 45.

A support arm 65, as shown in FIG. 1, is another type of object that can be held by and connected to the supporting collar 16 by the clip 28. The support arm 65 is preferably held by the clip 28 and used to support a display unit 84. The support arm 65 is comprised of two planar members 66, 67 joined at a bend 68. Preferably, the two planar members 66,67, when joined together, are perpendicular to one another. For added stability, the support arm 65 also has a gusset 69 connecting the two planar members 66,67. The support arm 65 is slideably mounted between the oppositely opposing grooves 30,31 of the clip 28 and in a channel 91 in the back wall 90 of the housing 85 of the display unit 84. In this way, the support arm 65 supports the display unit 84 by connecting it to the clip 28, and thus to the foundational unit 1.

Figure 8:
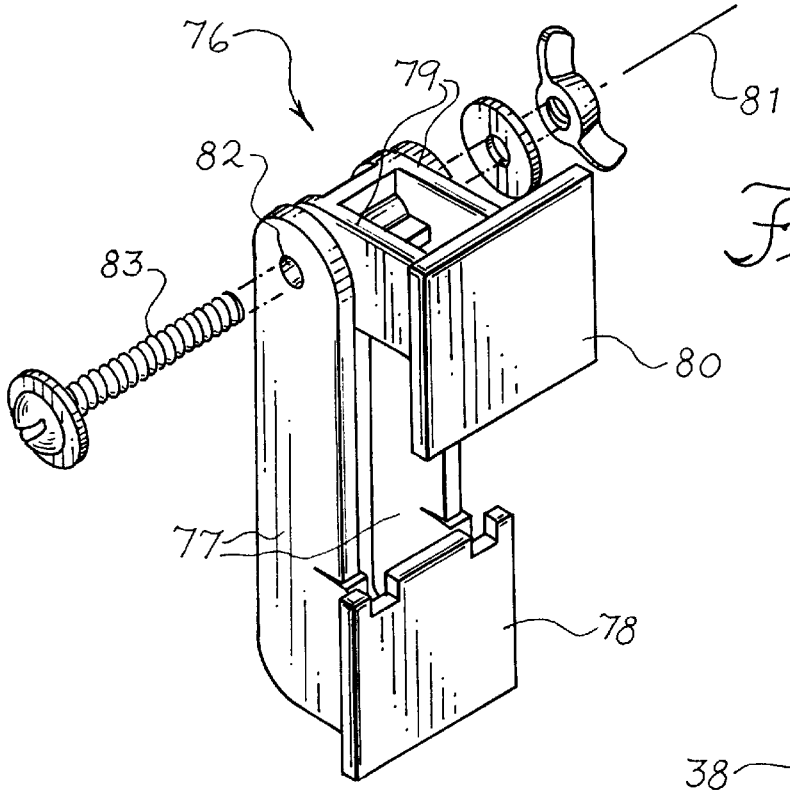
FIG. 8 is a perspective view of an alternative embodiment of a support arm.

FIG. 8 shows an alternative embodiment of a support arm 76 that can also be used to connect a display unit 84 to a clip 28. In FIG. 8, the support arm 76 is comprised of three pieces joined at two pivot points 74,75. The support arm 76 has a first planar mounting piece 80 perpendicularly connected to a plurality of parallel planar connecting pieces 79. The support arm 76 also has a second planar mounting piece 78 perpendicularly connected to a plurality of parallel planar L-shaped connecting pieces 77. The L-shaped connecting pieces 77 and the first parallel planar connecting pieces 79 have holes 82 and are pivotably connected to a connector 81 by two bolts 73,83 that fit through the holes 130 in the connector 81 and the holes 82 in both sets of connecting pieces 77,79. When connected, the second planar mounting piece 78 can be slideably mounted between the opposed grooves of a clip and the first planar mounting piece 80, which preferably can extend past the second planar mounting piece 78, can be slideably mounted in the channel on the back wall of the housing of a display unit. This alternate embodiment of the support arm 76 is preferably used in countertop and ceiling mounted systems when a display unit has to be displayed on one side of a column and connected to a supporting collar on the other side of a column.

In other embodiments of the support arm 76 shown in FIG. 8, the sets of connecting pieces 77,79 can be pivotably joined to each other at a single pivot point with one bolt through the aligned holes 82. However, a connector 81 that creates two pivot points 74,75 as shown in FIG. 8 provides a greater amount of flexibility and control over the orientation of a display unit that may be supported by the support arm 76.

Figure 9A:
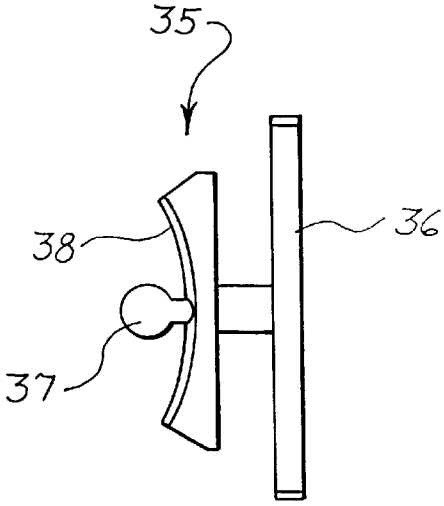
FIG. 9A is a plan view of a second alternate embodiment of a clip.

In still another embodiment of the invention, the modular dispenser and display system could be assembled without a support arm if the clip 28, as shown in FIG. 1, is modified to connect a display unit 84 directly to a supporting collar 16. In FIG. 9A, the clip 35 has two sides. One side of a clip 35 attaches to a supporting collar and is comprised of a peg 37 and a brace 38. The opposite side of the clip 35 is comprised of a planar mounting member 36 that can be slideably mounted in the channel of the back wall of the housing of a display unit.

Figure 9B:
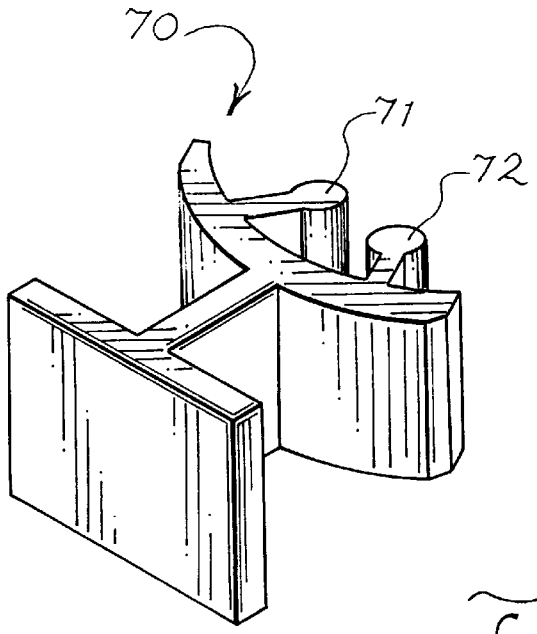
FIG. 9B is a perspective view of a third alternate embodiment of a clip.

The clip 70 in FIG. 9B is another alternate embodiment of the clip 28 in FIG. 1. The clip 70 in FIG. 9B is comprised of the same elements as the clip 35 in FIG. 9A, except that the clip 70 has a plurality of pegs 71,72. The arrangement of the pegs 71,72 allows the clip 70 to be connected to a supporting column with an orientation that cannot be achieved with the clip 28 as shown in FIG. 1.

Returning to FIG. 1, a display unit 84 is preferably an illuminated product advertisement held in place by a support arm 65 and comprised of a housing 85, a front panel 92, and a frame 93. A housing 85 has a back wall 90, and side walls 86,87. One wall of the preferred display unit, preferably the back wall 90, has a channel 91 for slideably accepting a support arm 65 or an alternate embodiment of a clip.

Figure 10:
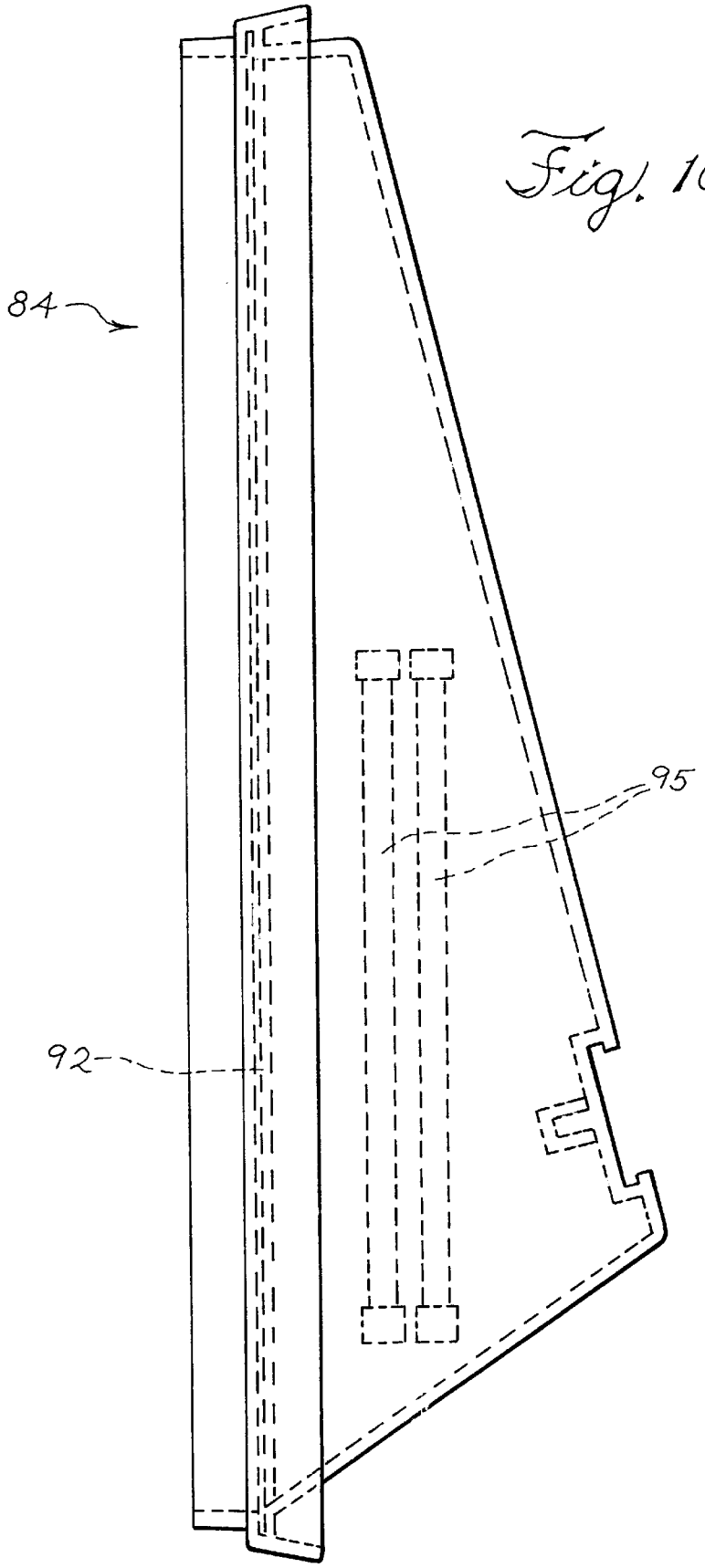
FIG. 10 is a side view of a display unit with a light assembly.

In the preferred embodiment, a display unit has four side walls (2 shown) 86,87 and the housing 85 is in the shape of a rectangle. A front panel 92 is preferably a planar product advertisement that conforms to the shape defined by the housing 85 and is made of a translucent material. A front panel 92 rests on the side walls 86,87, and together with the side walls 86,87 and a back wall 90, defines a box with an interior chamber. A frame 93 then preferably fits over the front panel 92, attaches to the side walls 86,87 of the housing 85, and thereby mounts the front panel 92 to the housing 85. In the preferred embodiment, the side walls 86,87 are shaped in a way that allows the front panel 92 to be angled toward point of purchase customers when the display unit 84 is supported as part of a complete modular dispenser and display system. Furthermore, as shown in FIG. 10, an illumination means, such as a fluorescent light assembly 95, is preferably contained in the chamber of a display unit 84, providing back lighting for the preferred translucent front panel 92 product advertisement.

Figure 11B:
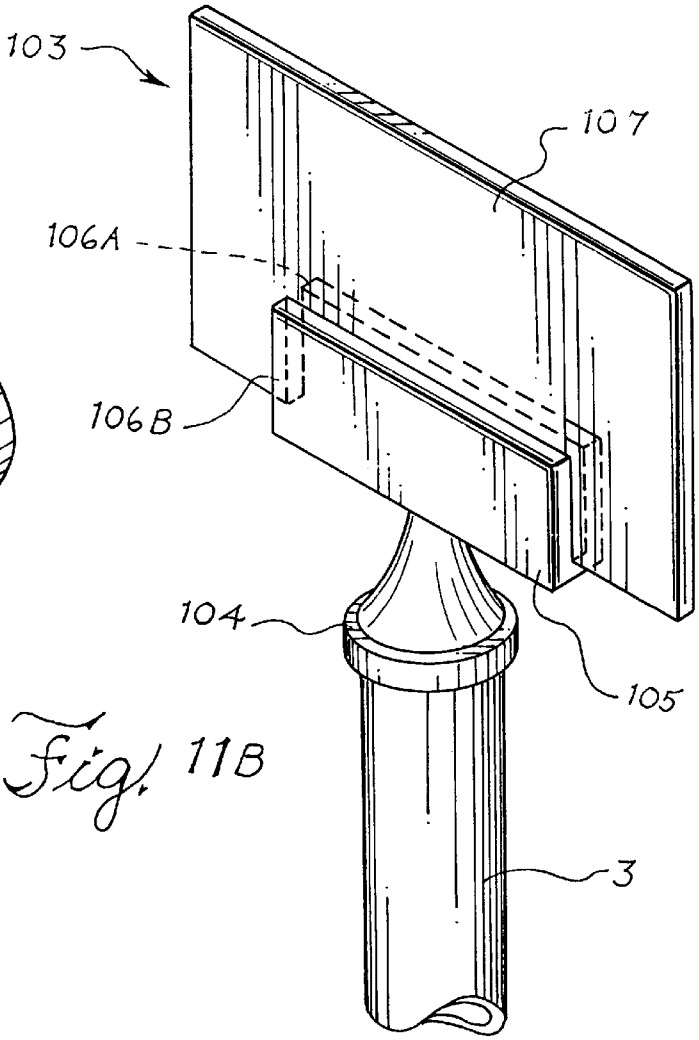
FIG. 11B is a front view of an alternate embodiment of a top sign.
Figure 11A:
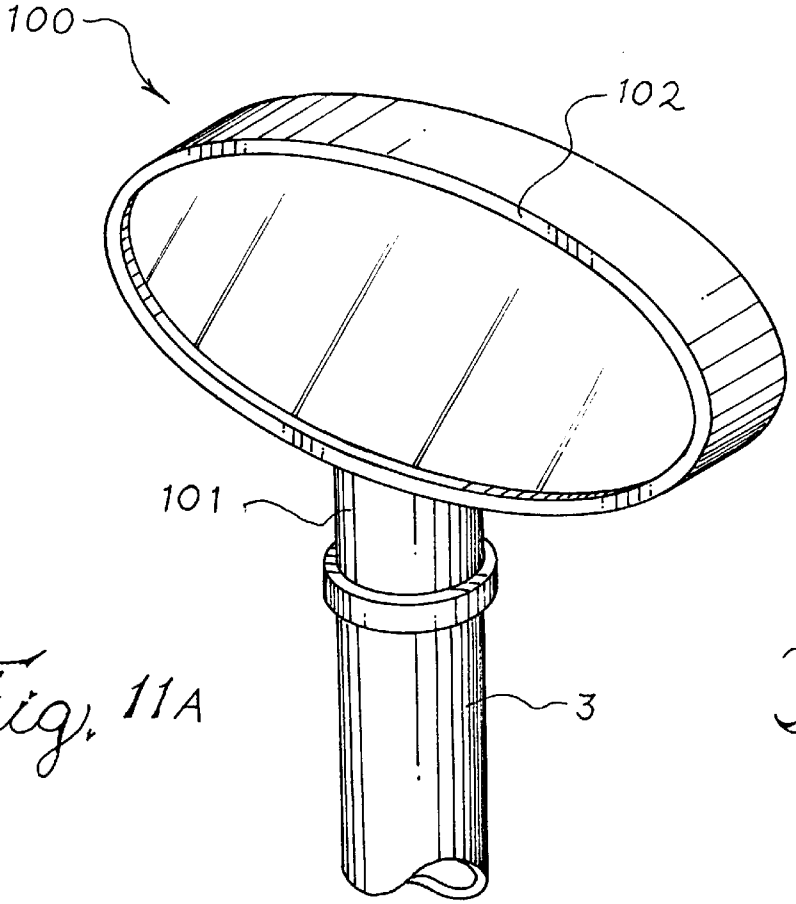
FIG. 11A is a front view of one embodiment of a top sign.

In addition to the display units and the display brackets described above, product advertisements can also be placed at on the tops of columns in a counter mounted system. FIG. 11A and 11B show two types of top signs. FIG. 11A shows an illuminated top sign 100 that is comprised of a column cap 101 connected to the top of a column 3 and supporting an illuminated advertisement 102. Meanwhile, FIG. 11B shows a top sign 103 that is comprised of a column cap 104 connected to the top of a column 3 and supporting a brace 105. The brace 105 is further comprised of two vertically oriented parallel planar pieces 106A,106B that grip an advertising panel 107 and hold it upright.

Figure 12:
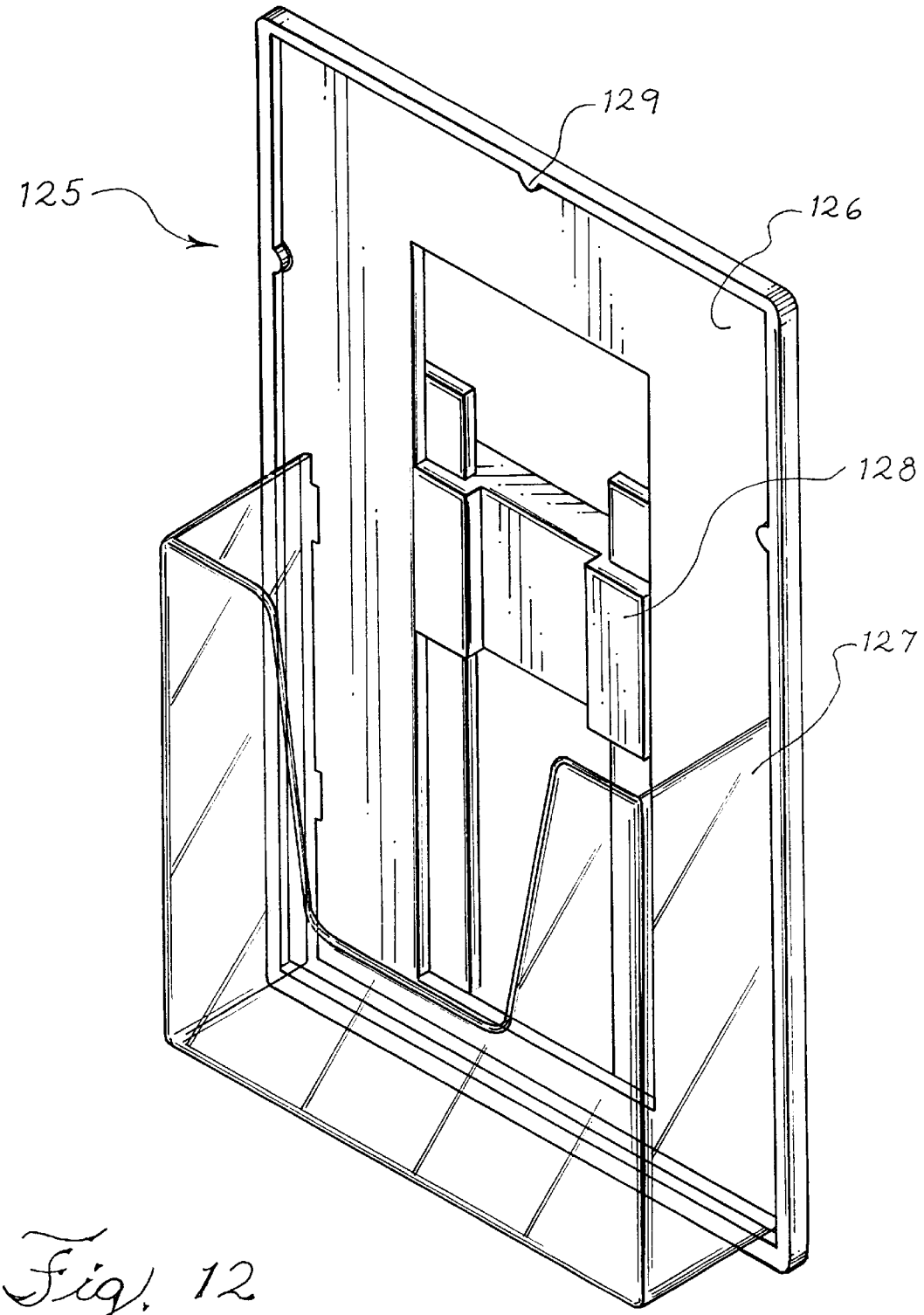
FIG. 12 is a perspective view of an alternate embodiment of a display unit.

An alternate embodiment of a display unit 125 can be used to hold catalogs or other product literature as shown in FIG. 12. The display unit 125 consists of a back plate 126, a bracket 127, and a channel 128. The bracket 127 is attached to the back plate 126 so as to form a receptacle between the bracket 127 and the back plate 126. Product literature or catalogs can then be inserted and held within the receptacle. In addition, flaps 129 located at various points around the edge of the back plate 126 and can be used to hold a product advertisement. The channel 128 is slideably mounted to the back plate 126, allowing the entire display unit 125 to be adjusted in height. The channel 128 can also slideably accept a support arm or an alternate embodiment of a clip, allowing the entire display unit 125 to be attached to a supporting collar and foundational unit.

All of the individual components described above can be combined and interchanged in order to form a custom designed modular dispenser and display system. There is no limit to the ways that the individual elements can be combined. Thus, by utilizing a discrete set of individual components, a user is able to custom design a system that is modular and can be adapted to meet both current and future needs. Some examples of various combinations of the discrete elements described above are shown in FIGS. 13, 14, and 15.

Figure 13:
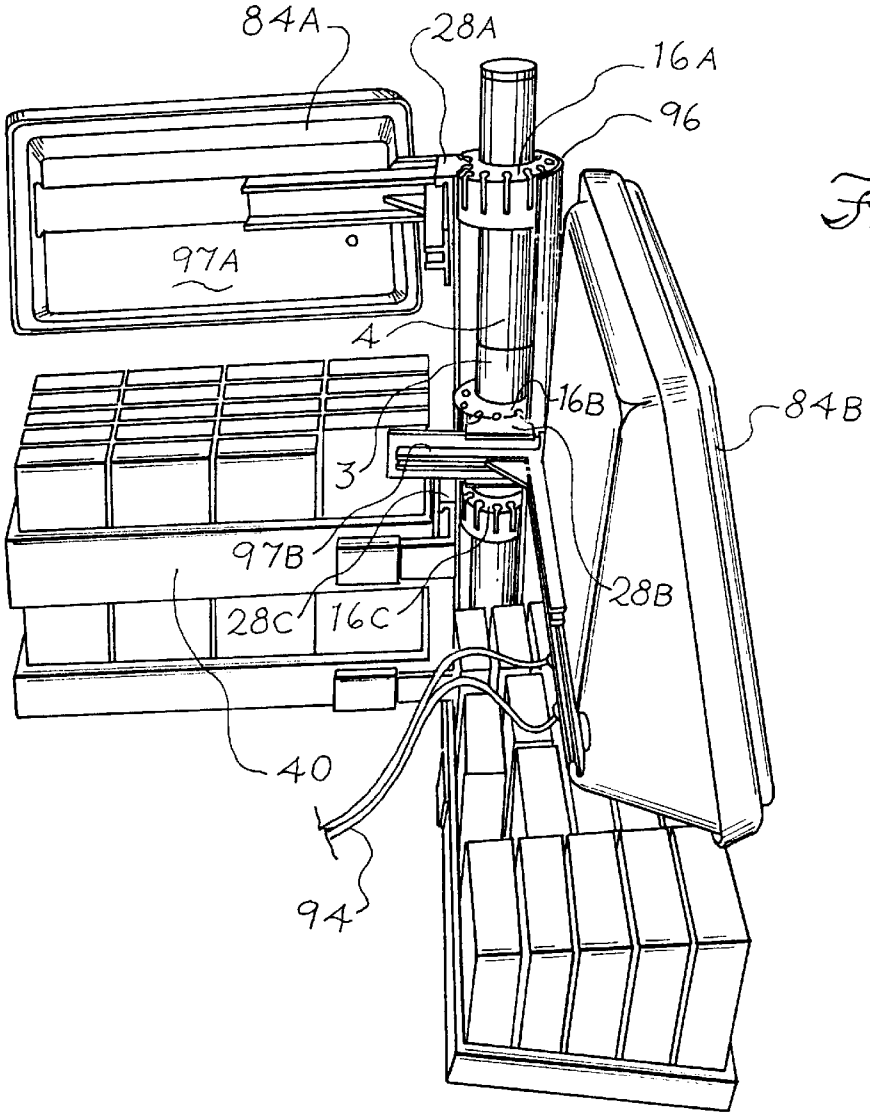
FIG. 13 is a rear view a first embodiment of the invention as assembled.

FIG. 13 is a rear view of an assembled version of one particular embodiment of a countertop mounted modular dispenser and display system. The particular embodiment utilizes a column 3 having an extension portion 4. The embodiment in FIG. 13 also shows three supporting collars 16A,16B,16C mounted around a single column 3 with an extension portion 4. At least one clip 28A, 28B,28C is attached to each supporting collar 16A,16B,16C. Support arms 97A,97B are slideably attached to two of the clips 28A, 28B, and display units 84A, 84B, having different dimensions, are slideably mounted to the support arms 97A, 97B. An expandable tray 40 is slideably attached to the third clip 28C.

In addition to the basic elements disclosed above, FIG. 13 also shows electrical cords 94 going into a display unit 84B. These electrical cords 94 are used to power the fluorescent light assemblies in the preferred embodiment. FIG. 13 also shows that a column 3, an extension portion 4, and supporting collars 16 may be covered by a decorative cover 96 that helps organize the cords 94.

Figure 14:
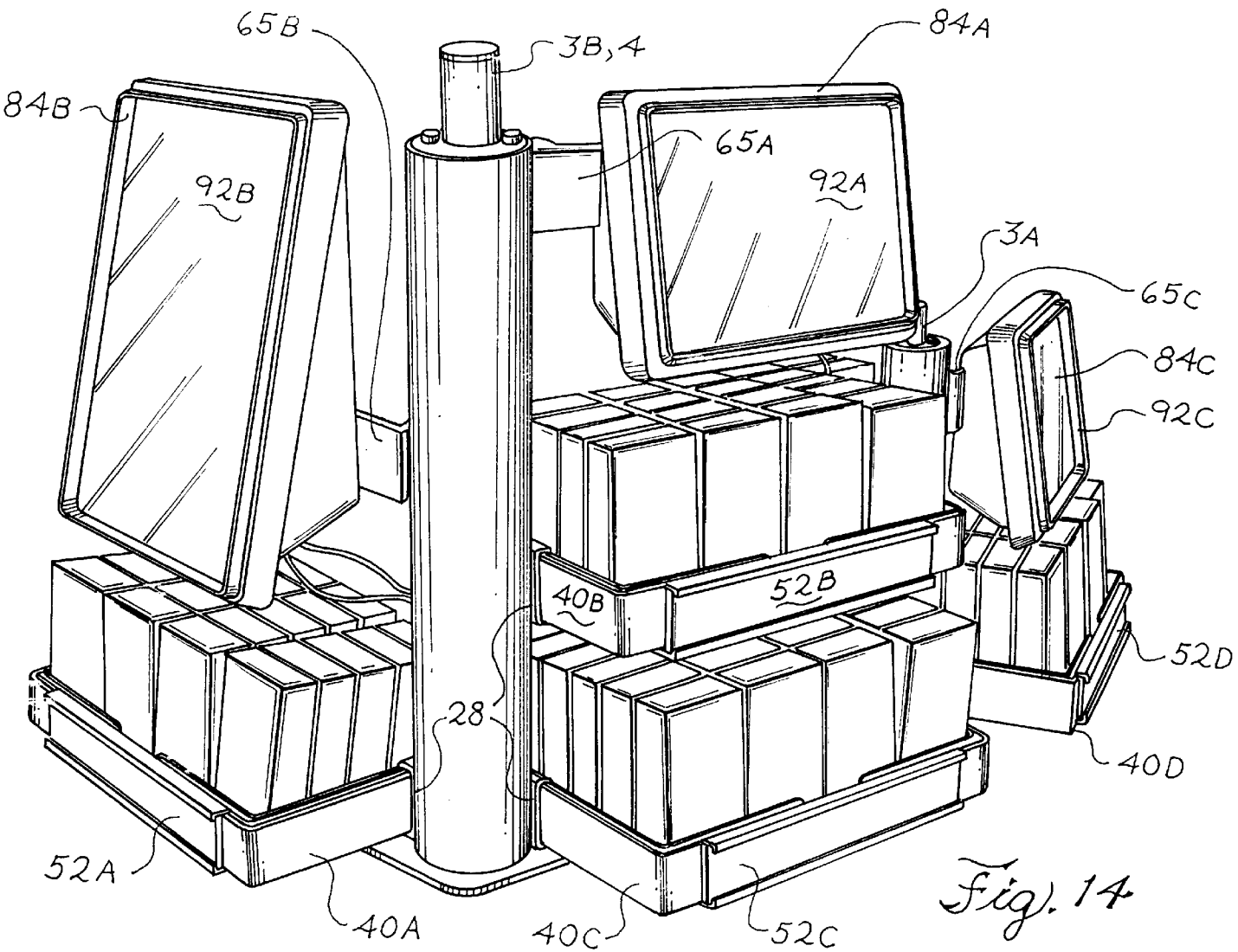
FIG. 14 is a front view of a first embodiment of the invention as assembled.

FIG. 14 shows the variety of ways that individual elements of the claimed modular dispenser and display system can be combined in a countertop system. In this particular embodiment of the invention, a first column 3A is used in cooperation with a second column 3B with an extension portion 4. The system in FIG. 14 also has three display units 84A,84B,84C with illuminated front panels 92A,92B,92C. The display units 84A,84B,84C are all adjusted to different heights, are supported by support arms 65A,65B,65C, and can have different dimensions. The system also has four expandable trays 40A,40B,40C,40D supported by clips 28 and adjusted to different heights. In addition, the front brackets 52A,52B,52C,52D on each expandable tray hold an planar advertising display.

Figure 15:
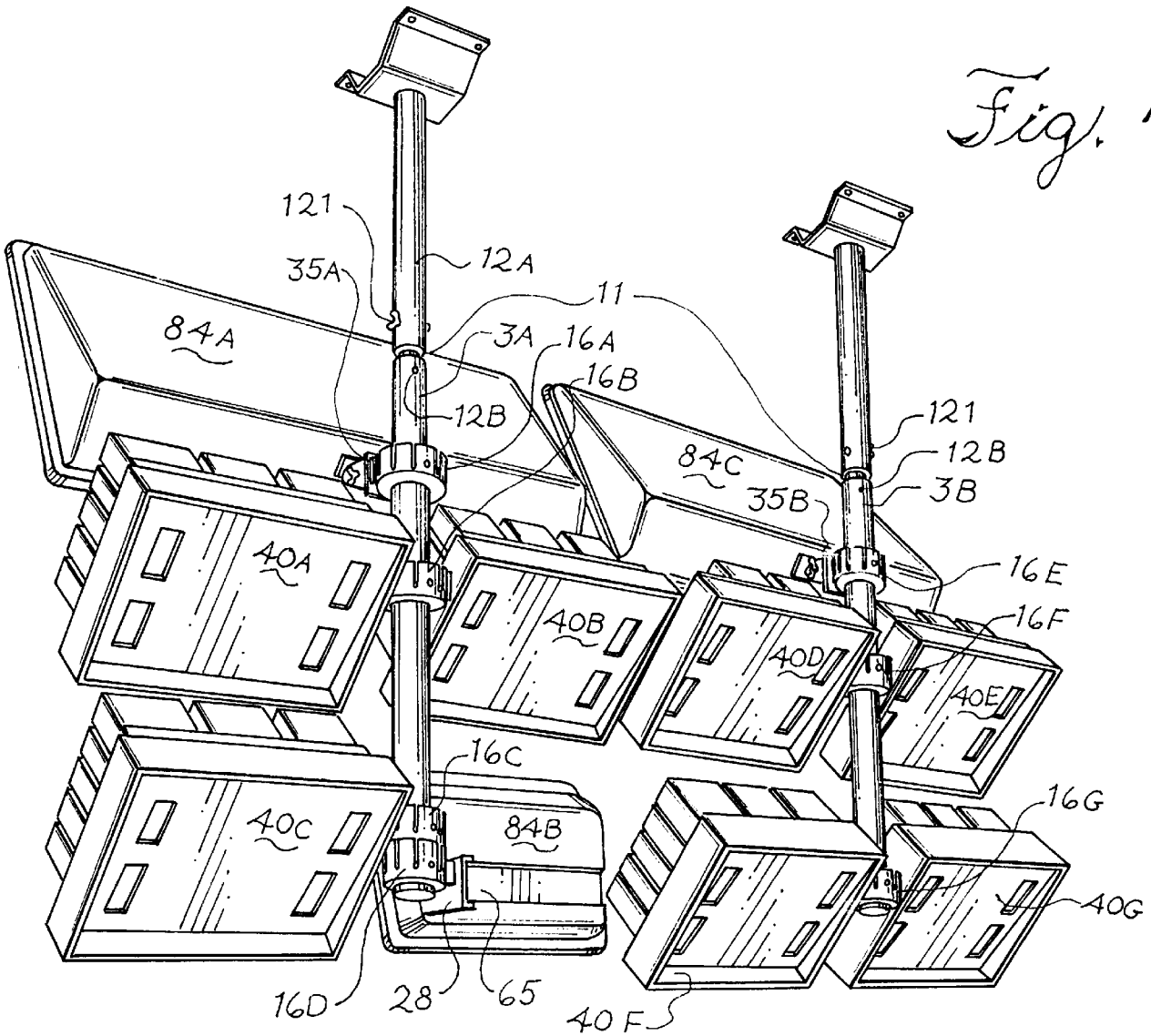
FIG. 15 is a rear view of a second embodiment of the invention as assembled.

FIG. 15 shows a rear view of an assembled version of a particular embodiment of a ceiling mounted modular dispenser and display system. The particular embodiment utilizes a ceiling mounted foundational unit, including two columns 3A,3B, as well as seven supporting collars 16A–G, ten clips (three shown) 28, 35A, 35B, seven expandable trays 40A–G, one support arm 65, and three display units 84A–C. The columns 3A,3B, also shown in FIG. 3, hang from a base 10 connected to the ceiling and have outer columns 12A,12B that are supported around inner columns 11 by pins 14 and cross screws 121. Supporting collars 16A–G are mounted around the columns 3A,3B at various heights and are used to support a plurality of trays 40A–G and display units 84A–C. The trays 40A–G are angled toward the floor, and are connected to the supporting collars 16B,16C,16F,16G with angled clips (not shown) as shown in FIG. 6. In this particular embodiment, three supporting collars 16B,16F,16G are used to support six trays 40A,40B, 40D–G. Three other supporting collars 16A,16D,16E are used to support display units 84A,84B,84C. Two display units 84A,84C are connected to the supporting collars 16A, 16E with clips 35A,35B, as shown in FIG. 9A. The third display unit 84B is connected to the supporting collar 16D with a straight clip 28 and a solid support arm 65.

Those skilled in the art to which the invention pertains may make modifications and other embodiments employing the principles of this invention without departing from its spirit or essential characteristics, particularly after considering the foregoing teachings. The described embodiments are to be considered in all respects only as illustrative and not restrictive and the scope of the invention is, therefore, indicated by the appended claims rather than by the foregoing description.

What is claimed is:

1. A modular dispenser and display system comprising:

a foundational unit;

a supporting collar that is moveably mounted to the foundational unit;

one or more trays that can be connected to the supporting collar;

a base;

a column connected to the base, the supporting collar movably mounted to the column; and an inner column having an axis, a plurality of vertically aligned holes through the axis, and a fixed cross pin;

a screw that can be inserted through and extend beyond the holes in the inner column; and a first hollow outer column that can fit around the inner column, having a lower edge with notches that can rest on the fixed cross pin whereby the outer column is supported by the pin; and a second hollow outer column that can fit around the inner column, having aligned holes such that the length of the column can be adjusted by placing the screw through different holes in the inner column and the second outer column.

2. A modular dispenser and display system comprising:

a foundational unit;

a supporting collar having at least one peripherial attachment means, that is moveably mounted to the foundational unit;

one or more trays that can be connected to the supporting collar;

wherein the attachment means on the supporting collar is comprised of a slot that is open on a top surface and along an outside surface of the supporting collar.

3. A modular dispenser and display system comprising:

a foundational unit;

a supporting collar that is moveably mounted to the foundational unit;

one or more trays that can be connected to the supporting collar;

wherein the tray is radially expandable.

4. A modular dispenser and display system comprising:

a foundational unit;

a supporting collar that is moveably mounted to the foundational unit;

one or more trays that can be connected to the supporting collar;

wherein the tray has a bottom portion comprised of a plurality of interleaved fingers.

5. A modular dispenser and display system comprising:

a foundational unit;

a supporting collar that is moveably mounted to the foundational unit;

one or more trays that can be connected to the supporting collar; and a clip, connecting the one or more trays to the supporting collar.

6. A modular dispenser and display system in accordance with claim 5 wherein the clip has opposed grooves, and the clip is mounted to the supporting collar.

7. A modular dispenser and display system in accordance with claim 6 wherein the clip is mounted to the supporting collar by a peg, registerable in a slot in the supporting collar, and a brace.

8. A modular dispenser and display system comprising:

a foundational unit;

a supporting collar that is moveably mounted to the foundational unit; and one or more trays that can be connected to the supporting collar; and one or more display units that can be connected to the supporting collar.

9. A modular dispenser and display system in accordance with claim 8 wherein the display unit further comprises:

a housing, having a channel for slideably accepting a clip or a support arm;

a front panel that can be attached to the housing; and a frame that attaches to the housing and holds the front panel on the housing.

10. A modular dispenser and display system in accordance with claim 8 further comprising a clip connecting the display units to the supporting collar.

11. A modular dispenser and display system in accordance with claim 10 wherein the clip has a planar member and the clip is mounted to the supporting collar by a peg, registerable in a slot in the supporting collar, and a brace.

12. A modular dispenser and display system comprising:

a foundational unit;

a supporting collar that is moveably mounted to the foundational unit;

a support arm, with a planar surface, that can be connected to the supporting collar; and one or more display units slideably mounted to the support arm.

13. A modular dispenser and display system in accordance with claim 12 wherein the support arm further comprises a first planar surface pivotably connected to a second planar surface.

14. A modular dispenser and display system comprising:

a foundational unit;

a supporting collar that is moveably mounted to the foundational unit;

a support arm, with a planar surface, that can be connected to the supporting collar;

one or more trays that can be connected to the supporting collar; and a display unit slideably mounted to the support arm.

15. A modular dispenser and display system in accordance with claim 14 further comprising a light assembly contained within the display unit for illuminating a translucent sign.

16. A modular dispenser and display system comprising:

a foundational unit;

a supporting collar that is moveably mounted to the foundational unit;

a clip, having opposed grooves and having a peg registerable in the slots in the supporting collar;

a support arm, with a planar surface, slideably mounted between the opposed grooves in the clip; and a display unit slideably mounted to the support arm.

17. A modular dispenser and display system comprising:

a foundational unit;

a supporting collar that is moveably mounted to the foundational unit;

a clip, having opposed grooves and having a peg registerable in the slots in the supporting collar;

a support arm, with a planar surface, slideably mounted between the opposed grooves in the clip;

a display unit slideably mounted to the support arm; and a tray slideably mounted between the grooves in the clip.

18. A modular dispenser and display system comprising:

a foundational unit;

a supporting collar that is moveably mounted to the foundational unit;

a clip, having opposed grooves and having a peg registerable in the slots in the supporting collar;

a support arm, with a planar surface, slideably mounted between the opposed grooves in the clip;

a display unit slideably mounted to the support arm;

a tray slideably mounted between the grooves in the clip; and a light assembly contained within the display unit wherein a translucent sign may be illuminated.

* * * * *